United States Patent [19]

Scelba

[11] 4,450,698

[45] May 29, 1984

[54] COMBINATION LOCKS

[75] Inventor: Stephen S. Scelba, Clifton, N.J.

[73] Assignee: Presto Lock, Inc., Garfield, N.J.

[21] Appl. No.: 348,715

[22] Filed: Feb. 16, 1982

[51] Int. Cl.[3] ..... E05B 37/02; E05B 63/00

[52] U.S. Cl. ..... 70/312; 70/334

[58] Field of Search ..... 70/69–76, 70/312, 334, 333

[56] References Cited

U.S. PATENT DOCUMENTS

| | | | |
|---|---|---|---|
| 1,655,840 | 1/1928 | Nichin | 70/334 |
| 3,120,117 | 2/1964 | Maynard | 70/334 |
| 3,633,388 | 1/1972 | Atkinson | 70/80 |
| 3,983,727 | 10/1976 | Todd | 70/323 |
| 4,308,731 | 12/1982 | Remington | 70/74 |

*Primary Examiner*—Robert L. Wolfe

*Attorney, Agent, or Firm*—Shapiro and Shapiro

[57] ABSTRACT

Combination locks employ dial-driven rotary elements for controlling the position of a locking member between locking and unlocking positions by peripheral cooperating of the respective elements with the locking member. Each rotary element is formed in a manner whereby no audible sound or difference in feel is produced during rotation of the element when the on-combination setting of the element is reached. This reduces the possibility that the lock may be picked.

9 Claims, 13 Drawing Figures

4
4
C
E
46
74
38
54
42
60
58
36
78
D
B
A
62
52
76
34

E
C
78
76
44
82
38
D
36
84
86
85
A
B
5
72
61
88
34
74

COMBINATION LOCKS

BACKGROUND OF THE INVENTION

The invention relates to combination locks of the type having a locking member, such as a pivotal or reciprocatory bolt, which is movable between locking and unlocking positions, and a plurality of individually rotatable elements which cooperate peripherally with the locking member for controlling the position of the locking member dependent on the rotational orientation of the elements.

One known form of lock of the above type, for example, employs a bolt adapted to pivot between locking and unlocking positions under the control of dial-driven sleeves having flanges forming the rotary elements. Each flange may, for example, have a periphery including a major portion disposed on an arc forming part of a circle, and a minor portion, which may be a flat, disposed within the circle, with the ends of the minor portion being disposed on the circle. The bolt may be spring urged into engagement with the peripheries of the respective flanges. In this arrangement, when all of the minor portions of the flange peripheries are mutually aligned in juxtaposition with the bolt, by suitable rotational manipulation of the dials into the "on-combination" setting of the lock, the bolt assumes an unlocking position allowing the lock to be opened. When, however, at least one of the sleeves is rotated out of the on-combination position, the respective flange cams the bolt against the spring action into a locking position in which the bolt engages a point on the major (circular) portion of the flange periphery. To reopen the lock, all of the flanges must be turned so as to present their minor peripheral (flat) portions to the bolt, allowing the bolt to spring into the unlocking position.

In a recent development in locks of the above type, see U.S. Pat. No. 4,308,731 to Remington, issued Jan. 5, 1982, and commonly assigned herewith, the minor portion of each flange periphery is formed as a notch, preferably a V-shaped notch, rather than a flat, and the bolt is formed with ridge portions adapted to be received in the respective notches when the flanges are all rotated into their on-combination settings. When any one of the flanges is rotated from its on-combination setting, the bolt is cammed to a locking position with the ridge portion associated with that flange moving out of the respective notch and into contact with the major (circular) portion of the flange periphery. Again, to restore the bolt to an unlocking position allowing the lock to be opened, all the flanges must be mutually aligned in positions allowing the ridge portions to enter the respective notches. This construction of lock offers certain advantages compared with locks using a flat bolt and flanges with flat rather than notched minor peripheral portions, The advantages are outlined in the Remington patent, the disclosure of which is incorporated herein by reference.

One problem which has been found may arise in locks of the above type is that it may be possible to detect either audibly or by feel, when rotating a dial, the point at which contact between the bolt and the respective flange periphery moves from the major postion of the periphery to the minor portion and vice versa. Thus, without prior knowledge of the on-combination setting of a lock, it may be possible by manipulating the dials, to determine the on-combination setting audibly or by feel, making the lock susceptible to being picked. The present invention seeks to minimize this possibility.

SUMMARY OF THE INVENTION

In one aspect, the invention provides a combination lock having a locking member movable between locking and unlocking positions, a plurality of rotary elements for controlling movement of the locking member between said positions by peripheral cooperation of the respective elements with the locking member, each rotary element having a periphery including a major portion and a minor portion, the major portion holding the locking member in locking position when the element is suitably rotated with any point on the major portion engaging the locking member, the major portion comprising a central section disposed on an arc defining a part of a circle and end sections connecting the major portion to opposite ends respectively of the minor portion, the minor portion being disposed within said circle and when suitably mutually aligned with the minor portions of the other rotary elements, allowing the locking member to assume an unlocking position, the ends of the minor portion being spaced inwardly of said circle and the end sections of the major portion each extending inwardly from a point on the circle to a respective end of the minor portion.

In a preferred form of the invention, the end sections of the major portion may each have two parts including a sloping ramp part extending inwardly from the respective point on the circle, and a non-sloping arcuate part extending from the ramp part to the respective end of the minor portion. Alternatively, each end section may comprise a single part having constant slope from the respective point on the circle to the respective end of the minor portion.

It has been found that rotary elements in accordance with the invention substantially eliminate any audible click or difference in feel when a contact point of the locking member moves between the major and minor portions of the periphery of the element as the element is rotated. Accordingly, the susceptibility of a lock incorporating such elements to being picked is substantially reduced. Broadly stated, therefore, the invention may be said to reside in a combination lock of the type referred to wherein the opposite end sections of the respective major portions of the rotary elements define means for providing that an operator may detect substantially no change in feel and no audible sound when a point of contact between the locking member and a respective element passes between the major and minor portions as the element is rotated.

In accordance with a further feature of the invention, as a means of providing additional security against unauthorized detection of the combination setting of the lock, the major peripheral portions of the respective rotary elements may be provided with a depression or the like for generating a false audible click or change in feel when traversed by the contact point of the locking member, the depression or the like being insufficient to provide movement of the locking member between locking and unlocking positions.

Additional features of the invention will be apparent from the ensuing description and claims taken in conjunction with the accompanying drawings.

DESCRIPTION OF PREFERRED EMBODIMENTS

One preferred embodiment of the invention, hereinafter described, is an improvement upon combination locks of the type described with reference to FIGS. 2–9 in particular of the Remington patent previously referred to. The Remington lock, parts of which are shown diagrammatically in accompanying FIGS. 1A–1C, has a locking member in the form of a pivotal bolt 10*a* and a plurality of axially aligned rotary camming elements for controlling pivoting movements of the bolt between locking and unlocking position, by peripheral cooperation of the rotary elements with the bolt, the respective rotational positions of the rotary elements determining the position of the bolt. Only one camming element 16*a* is shown in full in FIGS. 1A–1C. The rotary camming elements may, for example, be flanges formed on dial-driven sleeves.

Figure 1A:
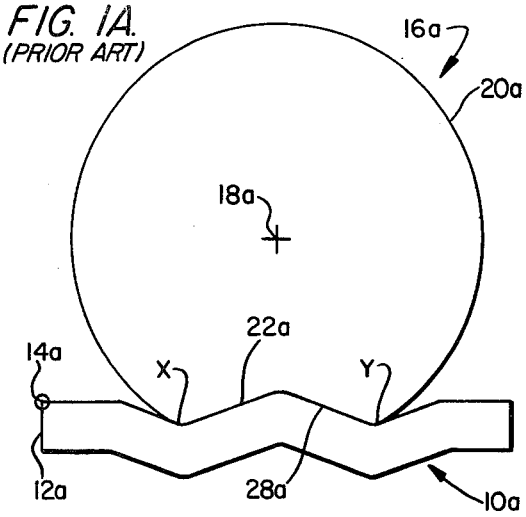
FIG. 1A. (PRIOR ART)
FIGS. 1A–1C are diagrammatic views illustrating a rotary camming element-bolt arrangement employed in a known form of pivoting bolt combination lock having dial-driven sleeves.
Figure 1B:
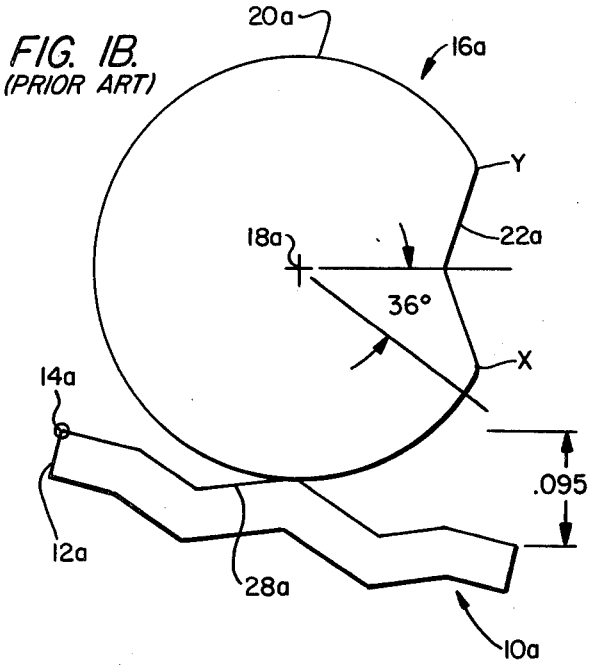
FIG. 1B. (PRIOR ART)
Figure 1C:
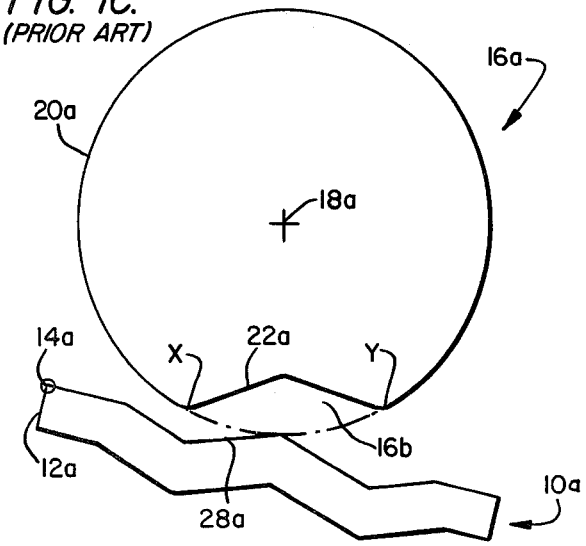
FIG. 1C. (PRIOR ART)

As shown in FIGS. 1A–1C, each rotary element has a periphery including a major portion 20*a* and minor portion 22*a*. The major portion is formed as an arc of a circle centered at the center 18*a* of the respective element, and the minor portion is formed as a substantially V-shaped notch within the circle.

Bolt 10*a* may be pivoted substantially about line 14*a* at one end 12*a* of the bolt, and the bolt may be spring urged upwardly toward peripheral engagement with elements 16*a*. Ridge portions 28*a* are formed in the bolt, to be received in the respective notches of the rotary elements.

Each dial to which the rotary elements are coupled may have, for example, 10 discrete combination indicia around its perimeter. Accordingly, the dials and rotary elements are indexed in rotational steps of 36° in moving from indicium setting to indicium setting. Thus, when moving a rotary element from the position shown in FIG. 1A (the on-combination condition of the lock with the bolt in unlocking position) by one indicium setting in either direction, the element moves through 36° of arc. As more fully described in the Remington patent, in either of these settings of the element (removed by one indicium from the on-combination setting) the bolt should contact the major peripheral portion of the respective element, and accordingly the minor peripheral portion or notch 22*a* of each element is constructed to subtend an angle slightly less than 72° at center 18. The angle is subtended between the end points X and Y of the notch which are disposed on the circular arc defining the major portion.

As noted, when all of the rotary elements are rotated so that the notches are mutually aligned and presented to the bolt, the ridge portions are spring urged into receiving engagement in the respective notches as shown in FIG. 1A and the bolt assumes an unlocking position allowing the lock to be opened. When one or more of the rotary elements is rotated from this position in either direction to another indicium setting, a camming action occurs between the element and the bolt, forcing the bolt down against the spring action. Thus, the bolt may be held in unlocked position as shown in FIG. 1B with the respective ridge portions thereof engaging the major (circular) peripheral portion of the respective rotary element. The stroke of the bolt may be of the order of 0.095 inches.

FIG. 1C shows a situation in which element 16*a* has its notch 22*a* suitably aligned to receive the respective ridge portion 28, but the bolt is held in locking position by at least one of the other rotary elements 16*b* which has been rotated out of its on-combination setting. To open the lock from conditions such as those shown in FIGS. 1B and 1C, it is understood that the rotary elements must all be suitably rotated into the mutual alignment shown in FIG. 1A.

In theory, when, for example, element 16*a* is rotated clockwise from the position shown in FIG. 1B, it is expected there should be no detectable bolt movement, audible sound or change in feel when point X moves over the peak of the relevant ridge portion 28, if the bolt is held in the locking position of FIG. 1B by element 16*b* which is "off combination". In practice, however, due to manufacturing tolerances and imperfections, in both the bolt and sleeve mounting arrangements, for example, a slight vertical movement (of the order of 0.006 inches, for example) of the bolt, insufficient to move it to an unlocking position, may occur when point X passes over the relevant peak. This may be accompanied by an audible click or change in feel of the dial rotation. Similar considerations may apply during continued rotation of element 16*a*, when point Y encounters the peak of the relevant ridge portion. Accordingly, by careful manipulation of the respective dials, it may be possible to ascertain, audibly or by feel, when each is brought into its on-combination setting. There is, therefore, a possibility of the lock being picked.

Figure 2A:
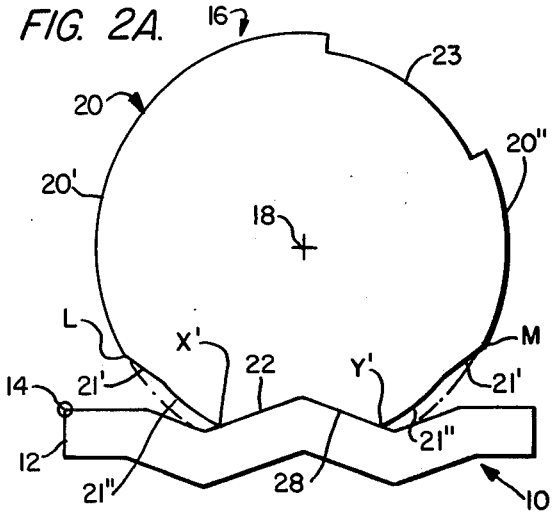
FIG. 2A–2C are similar diagrammatic views illustrating an improved rotary camming element-bolt arrangement employed in a combination lock in accordance with the invention.
Figure 2B:
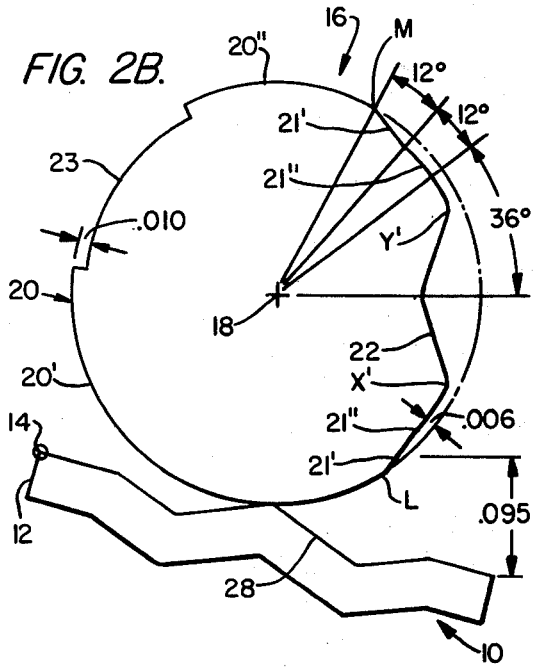
Figure 2C:
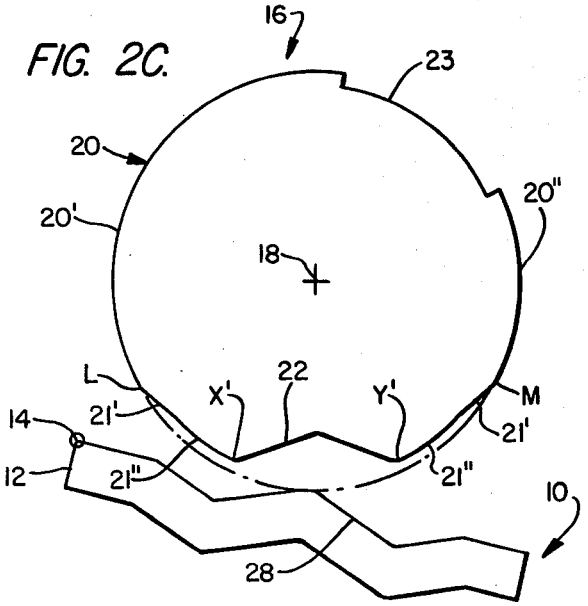

The above possibility is minimized in accordance with the present invention, by modifying the peripheral profile of the rotary elements, as shown in FIGS. 2A–2C, while retaining all other characteristics of the previously described structure. To this end, each rotary element 16 has a periphery including a major portion 20 extending clockwise (as drawn) from point X′ to point Y′, and a minor portion 22 again in the form of a substantially V-shaped notch with its ends at points X′ and Y′. Major portion 20 has a central section (divided into parts 20′ and 20″ by means yet to be described) and end sections, yet to be described. The central section is disposed on a circular arc, equivalent to the circular arc of the elements in the Remington lock, and points X′ and Y′ are spaced inwardly of the circular arc by a small amount which may, for example, be of the order of 0.006 inches (i.e., conforming substantially to the slight vertical movement of which the bolt is capable due to manufacturing tolerances and the like as described above). The end sections of major portion 20 extend from points L and M on the circular arc (the ends of the central section) to end points X' and Y' of the minor portion 22. The end sections may each include an inwardly sloping ramp part 21' leading from point L or M and a non-sloping arcuate part 21'' centered on point 18 and leading to point X' or Y', respectively.

Each notch 22 may again subtend an angle somewhat less than 72° at point 18, this angle being equivalent to the corresponding notch angle in the Remington structure. The junction between each ramp part 21' and the adjacent arcuate part 21'' may, for example, be at a point spaced about 48° from the centerline of the respective notch and points L and M may, for example, be about 60° from the centerline (see FIG. 2B).

The lock is provided with a pivotal bolt 10 having ridge portions 28 conforming to those in the Remington lock.

With the modified construction of rotary elements as described above, there is substantially no difference of feel or audible indication when the point of contact of the bolt moves between the minor and major portions of the periphery of an element. For example, when element 16 is moved from the position shown in FIG. 2C (where one or more of the other lock elements **16*b* is in an off combination position) there may even be no contact between the element and the bolt up to 48° of rotation of the element, i.e., the bolt may only engage the rotary element at the junction between ramp part 21' and arcuate part 21''**. It has been found almost impossible to feel the engagement of the bolt, and there is no audible click when the bolt disengages from the element (when rotating from the FIG. 2B position, clockwise, to the FIG. 2C position). Thus, the lock has improved security against being picked. When all the elements except one are in on-combination settings, the bolt follows the contour of the last element and moves to unlocking position when this element attains its on-combination setting.

In an alternative construction, the end sections of the major peripheral portion of an element may have a constant slope inwardly from points L and M respectively to points X' and Y' respectively, but the first form of the element, including the arcuate parts, is preferred.

As a further means of confusing any attempt to determine the combination of a lock, by sound and/or feel, the rotary elements may include means for producing a false click and on-combination feel when the element is rotated. This may, for example, comprise an elongate sharp-cornered notch, or like depression 23 in the major portion which provides a sound and feel simulating the sound and feel encountered with notches of the type used in the Remington patent, but having insufficient depth to allow the bolt to move from locking to unlocking position. Each such depression may, for example, be about 0.01 inches deep and extend for about 56°. Further confusion may be created by positioning the false notches at different locations on different elements. This may, for example, be accomplished by placing notch-forming elements in different positions in the respective cavities of a multi-cavity mold used for making the rotary elements.

It is now appropriate to describe an actual combination lock employing the bolt and rotary camming element arrangement of the invention as just described in connection with FIGS. 2A–2C. As shown in FIGS. 3–9, principal parts of the lock include combination dials A, sleeves B, a shaft C, a bolt D, and a frame E.

Each dial A is supported on shaft C by a corresponding sleeve B. The dials have internal gear teeth 30 that mesh with external gear teeth 32 of the sleeves. The sleeves are held in successive abutting relationship by a coil compression spring 34 on the shaft, which urges the sleeves toward a collar 36 integral with the shaft. Opposite ends of the shaft may be supported upon brackets 38, one of which is shown in detail in FIG. 9. Each bracket has a hole 40 into which the corresponding end of shaft C is inserted. Spring 34 is compressed between one of the brackets and an adjacent sleeve as shown in FIG. 4.

Figure 3:
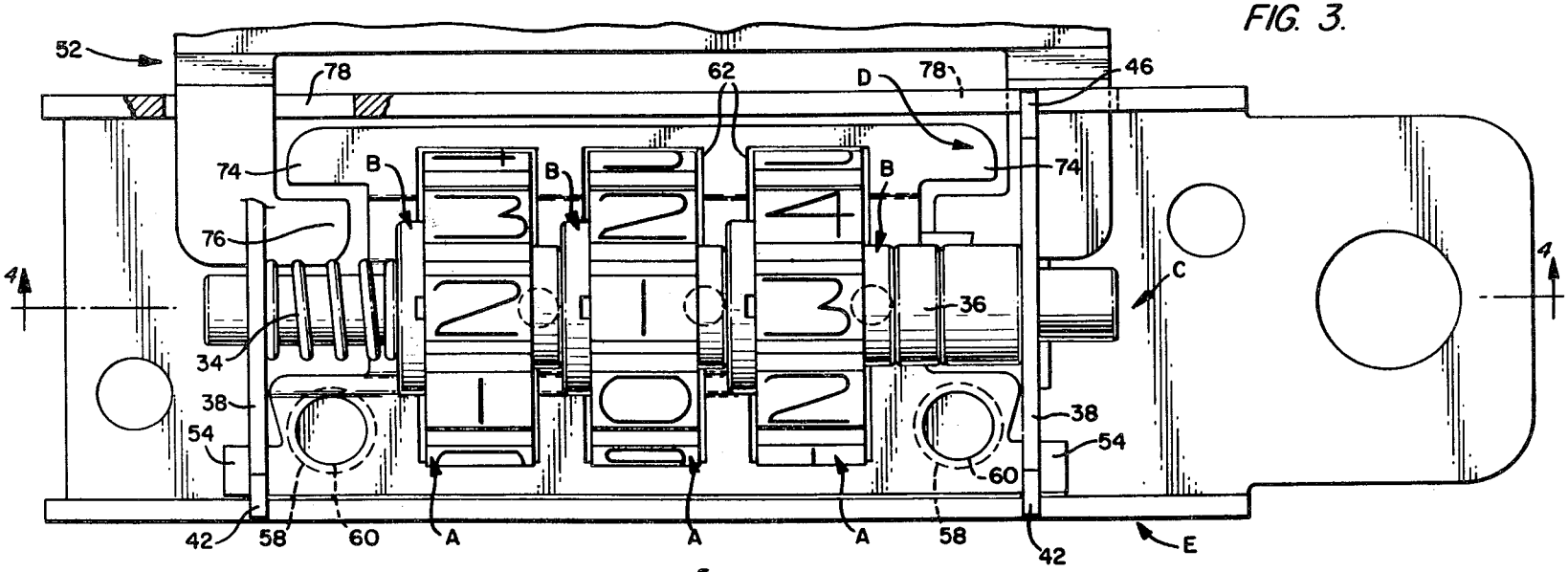
FIG. 3 is a top plan view, partially broken away, illustrating a pivoting bolt combination lock made in accordance with the invention, the lock being illustrated in association with a hasp partially shown.
Figure 5:
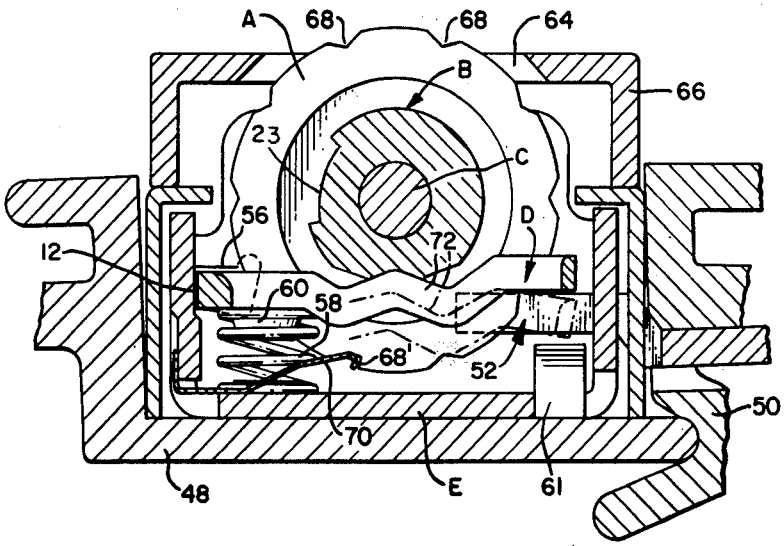
FIG. 5 is a vertical sectional view taken along line 5—5 of FIG. 4, this view also illustrating a cover for the lock and valance members adapted to be mounted on luggage or the like to which the lock may be attached.

Frame E may be generally U-shaped in cross-section, as shown in FIG. 5, and each bracket 38 may have protrusions 42, 44 and 46 that enter corresponding slots in the adjacent walls of the frame. The frame may be supported on a valance member 48 (FIG. 5) applied to an edge of part of a luggage case, for example, in a conventional manner. A mating valance member 50, may support a hasp 52 in a conventional manner, as indicated in FIGS. 3 and 5. The parts of the luggage case may be hingedly connected, and may be held closed, one upon the other, by engagement of hasp 52 with bolt D.

The bolt is supported along edge 12 for pivotal movement relative to the frame and the assembly of dials and sleeves. In the form shown, this is accomplished by providing lugs 54 at opposite ends of the bolt that are received in slots 56 of brackets 38. The slots are shaped to accommodate the pivotal movement of the bolt. Coil compression springs 58 adjacent to opposite ends of the bolt near edge 12 are positioned between the bolt and the frame to bias the bolt toward the sleeve. The bolt may have locating bosses 60 for the springs. A stop 61 limits movement of the bolt away from the sleeves.

Figure 4:
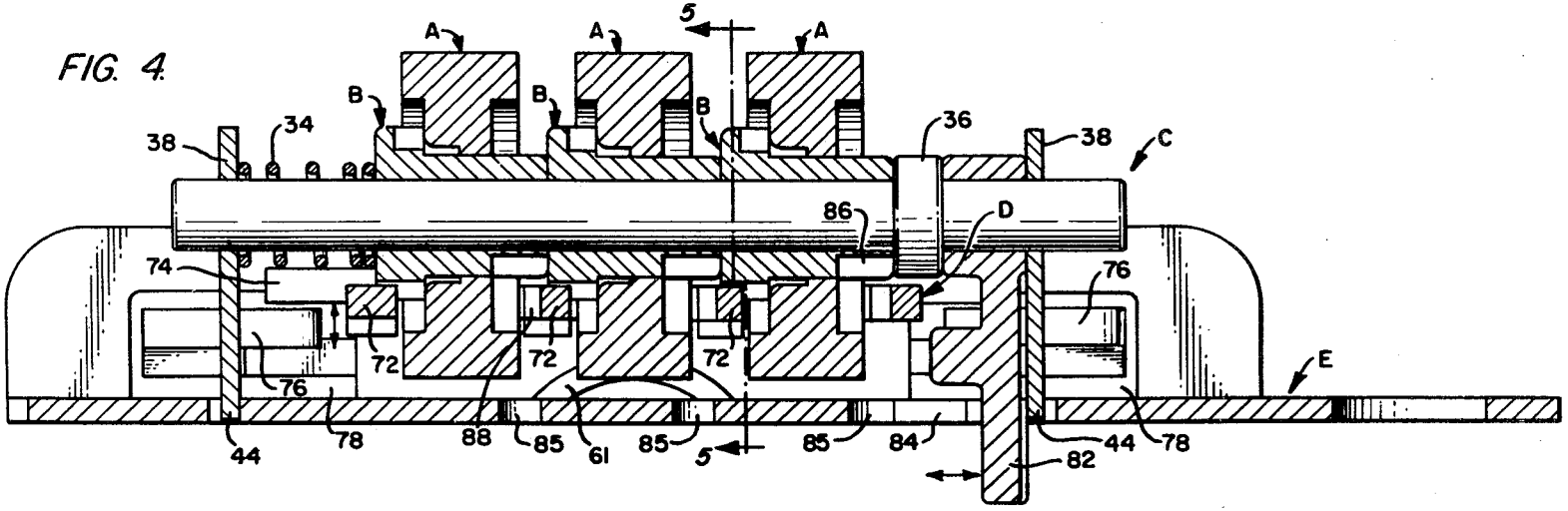
FIG. 4 is a vertical sectional view taken along line 4—4 of FIG. 3.
Figure 6:
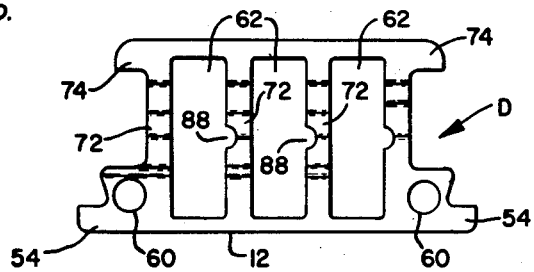
FIG. 6 is a top plan view of a pivoting bolt used in the lock.
Figure 7:
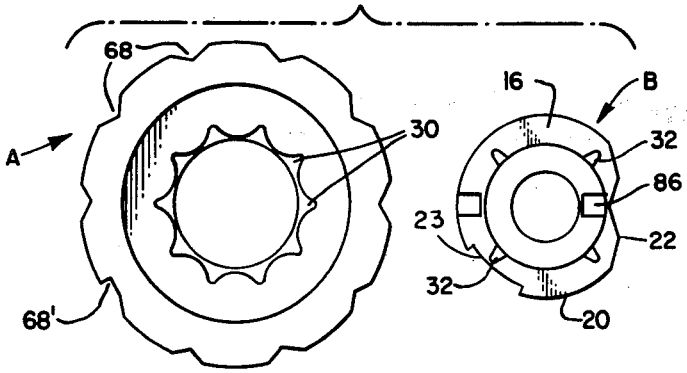
FIG. 7 is an end view of a dial and associated flanged sleeve which may be employed in the invention.
Figure 8:
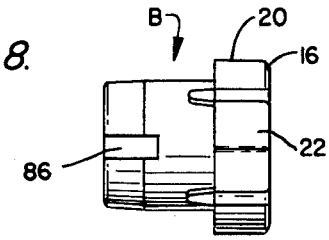
FIG. 8 is a side elevation view of the sleeve of FIG. 7.
Figure 9:
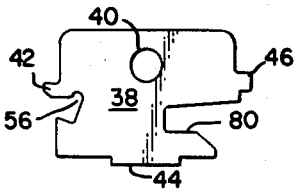
FIG. 9 is a plan view of a bracket that may be employed for supporting parts of the lock mechanism on a frame.

As shown in FIGS. 3, 4 and 6, the bolt has a series of openings 62 freely receiving the dials A so that the bolt may engage sleeves B without interference from the dials. The dials may also protrude through corresponding openings 62 in a cover plate 66 (see FIG. 5), where the combination indicia of the dials are displayed to the user. Each dial may have ten combination indicia equally spaced about its circumference, with successive indicia separated by indexing notches 68. The indexing notches cooperate with arms of a dial spring 70 as shown in FIG. 5. In the form shown the dial spring has its base supported in a slot of the frame and has a resilient arm for each dial that enters the indexing notches of that dial. As shown, the indexing notches may be symmetrical V-shaped notches, but one notch, 68', may have a radial surface that engages the associated arm of the dial spring to stop rotation of the dial when the dial is rotated in a given direction (clockwise in FIG. 5) to a particular rotational position. This feature permits rapid setting of all the dials to a zero position, for example.

Each of the sleeves B has a flange forming the rotary camming element 16 described in connection with FIGS. 2A–2C. The notches, recesses, and the like in elements 16 are somewhat exaggerated in FIGS. 5 and 7 for clarity. As shown in FIGS. 5 and 6, bolt D has a ridge 72 with portions that mate with corresponding notches 22 when the sleeves are turned to the rotational position of FIG. 5. The bolt has latching lugs 74 adapted to engage corresponding lugs 76 (see FIG. 3) of the hasp, but when the bolt is in the unlocked position of FIG. 5, there is no engagement with the hasp. Lugs 76 of the hasp enter the frame E via slots 78 and are received in slots 80 of brackets 38 (see FIG. 9) tapered to guide lugs 76 to a predetermined position when the parts of the luggage case are closed.

When the bolt is in the full-line position of FIG. 5, all of the dials are on-combination and the lock may be opened. If any dial is turned off-combination, the corresponding camming element 16 will move the bolt to the phantom line (locked) position shown in FIG. 5, positioning latching lugs 74 of the bolt for engagement with the corresponding lugs 76 of the hasp and preventing withdrawal of the hasp from the frame E.

The action of the camming element and bolt assembly just described is precisely the same as described with reference to FIGS. 2A–2C, with all of the attendant advantages.

Prior combination locks employing pivoting bolts in association with rotating sleeves having cams may employ a mechanism permitting the user to change the combination when the dials are on-combination. Such a mechanism has also been included in the foregoing embodiment of the invention and comprises a lever 82 (see FIG. 4) mounted on shaft C and protruding through a slot 84 in the frame. By moving lever 82 to the left in FIG. 4 against the bias of spring 34, the sleeves B may be moved to the left relative to the corresponding combination dials A to disengage the gear teeth 32 of the sleeves from the gear teeth 30 of the dials. If lever 82 is held in its leftward position (it may be so held by turning it slightly and engaging it with a branch of slot 84), the combination dials may be turned independently of the sleeves and set to a new combination. When lever 82 is returned to the position illustrated in FIG. 4 (under the bias of spring 34) the sleeves will be reengaged with the dials and the lock will operate in its normal manner, but with a new combination.

Prior combination locks also may employ a combination "finding" feature that permits the combination to be determined when the lock has been opened and the dials scrambled. For this purpose the frame has holes 85 for receiving a probe, and the sleeves have recesses 86 into which the probe may be inserted when the sleeves are turned to their unlocked position. Bolt D has recesses 88 (see FIG. 6) for passing the probe.

It will be evident from the preceding description that the invention provides combination locks affording good protection against unauthorized determination of the opening combination. While only preferred embodiments of the invention have been described herein in detail, the invention is not limited thereby and modifications may be made within the scope of the attached claims. For example, while the invention has been specifically described in relation to rotary camming elements having notched minor peripheral portions, it may also be useful with elements having flat minor peripheral portions. Additionally, means other than camming engagement between a respective element and the locking member may be used for moving the locking member between unlocking and locking positions. Also, while a pivoting bolt is described in the preferred embodiment, the bolt may alternatively be adapted to slide or reciprocate between its respective positions.

We claim:

1. A combination lock having a locking member movable between locking and unlocking positions, a plurality of rotary elements for controlling the position of the locking member by peripheral cooperation of the respective elements with the locking member, each rotary element having a periphery including a major portion and a minor portion, the major portion holding the locking member in locking position when the element is suitably rotated with any point on the major portion engaging the locking member, the major portion comprising a central section disposed on an arc defining a part of a circle and end sections connecting the major portion to opposite ends respectively of the minor portion, the minor portion being disposed within said circle and when suitably mutually aligned with the minor portions of the other rotary elements, allowing the locking member to assume an unlocking position, the ends of the minor portion being spaced inwardly of said circle and the end sections of the major portion each extending inwardly from a point on the circle to a respective end of the minor portions.

2. The lock of claim 1 wherein the minor portion of the periphery of each element is in the form of a notch and the locking member has ridge portions adapted to be received in the respective notches when the rotary elements are rotated into positions in which the respective notches are suitably mutually aligned.

3. The lock of claim 2, wherein the notches are V-shaped.

4. The lock of claim 1, wherein the end sections of each element each have a sloping ramp portion extending inwardly from the respective point on the circle, and a non-sloping arcuate portion extending from the ramp portion to the respective end of the minor portion.

5. The lock of claim 1, wherein the locking member is a pivotal bolt.

6. The lock of claim 1 including, for each element, means for providing a false indication that the element is in a setting for allowing the locking member to assume the unlocking position.

7. The lock of claim 6, wherein the means for providing a false indication comprises a depression in the major peripheral portion of the element for producing at least one of a sound and difference in feel when traversing the locking member upon rotation of the element, the depression being of insufficient depth to allow movement of the locking member to unlocking position.

8. The lock of claim 1 including biasing means urging the locking member to contact the peripheries of the respective rotary elements.

9. A combination lock having a locking member movable between locking and unlocking positions, a plurality of rotary elements for controlling the position of the locking member by peripheral cooperation of the respective elements with the locking member, each rotary element having a periphery including a major portion and a minor portion, the major portion holding the locking member in locking position when the element is suitably rotated with any point on the major portion engaging the locking member, the minor portion when suitably mutually aligned with the minor portions of the other rotary elements, allowing the locking member to assume an unlocking position, and the major portion having opposite end sections defining means for providing that an operator may detect substantially no change in feel and substantially no audible sound when a point of contact between the locking member and the rotary element passes between the major and minor portions as the element is rotated.

* * * * *